US009794701B2

(12) United States Patent
Flood et al.

(10) Patent No.: US 9,794,701 B2
(45) Date of Patent: Oct. 17, 2017

(54) GATEWAY FOR A WIRELESS HEARING ASSISTANCE DEVICE

(75) Inventors: Stephen Paul Flood, Eden Prairie, MN (US); Beau Jay Polinske, Minneapolis, MN (US); Jeffrey Paul Solum, Shorewood, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 411 days.

(21) Appl. No.: 13/601,602

(22) Filed: Aug. 31, 2012

(65) Prior Publication Data

US 2014/0064528 A1 Mar. 6, 2014

(51) Int. Cl.
*H04R 25/00* (2006.01)

(52) U.S. Cl.
CPC ..... *H04R 25/554* (2013.01); *H04R 25/558* (2013.01); *H04R 2225/41* (2013.01); *H04R 2225/55* (2013.01)

(58) Field of Classification Search
CPC ..... H04R 25/554; H04R 25/55; H04R 25/02; H04R 25/43; H04R 25/70; H04R 25/407; H04R 25/405; H04R 25/606; H04R 2225/39; H04R 2225/41; H04R 2225/55; H04R 2225/51; H04R 2225/61; H04R 2225/67; H04R 2225/021; H04R 2225/023; H04R 2225/025; H04R 2225/59; H04R 1/1016; H04R 1/1044; H04R 25/30; H04R 25/552; H04R 25/556; H04R 25/558; H04M 1/72591; H04M 1/72597; H04M 1/7253; H04M 1/72533; H04M 1/72536; H04M 1/72547; H04M 1/72563; H04M 1/72569; H04M 1/6066
USPC ..... 381/315, 23.1, 60, 312, 314, 71.6, 72
See application file for complete search history.

(56) References Cited

U.S. PATENT DOCUMENTS

| | | | |
|---|---|---|---|
| 5,086,385 | A | 2/1992 | Launey et al. |
| 5,636,285 | A | 6/1997 | Sauer |
| 5,721,783 | A | 2/1998 | Anderson |
| 6,021,207 | A | 2/2000 | Puthuff et al. |
| 6,496,107 | B1 | 12/2002 | Himmelstein |
| 6,988,070 | B2 | 1/2006 | Kawasaki et al. |
| 7,062,223 | B2 | 6/2006 | Gerber et al. |
| 7,457,426 | B2 | 11/2008 | Drtina |

(Continued)

OTHER PUBLICATIONS

U.S. Appl. No. 14/450,041, filed Aug. 1, 2014, Method and Apparatus for Conveying Information From Home Appliances to a Hearing Assistance Device.

(Continued)

*Primary Examiner* — Huyen D Le
(74) *Attorney, Agent, or Firm* — Schwegman Lundberg & Woessner, P.A.

(57) ABSTRACT

Disclosed herein, among other things, are methods and apparatus for providing a gateway for a wireless hearing assistance device. One aspect of the present subject matter relates to a method for wirelessly communicating with a hearing assistance device. One or more message and alert inputs are received and the message and alert inputs are processed to obtain an output. The output is wirelessly transmitted to a hearing assistance device, and the output is configured to be played via audio to a wearer of the hearing assistance device and to interrupt a current audio stream being played to the wearer, in various embodiments.

16 Claims, 2 Drawing Sheets

(56) References Cited

U.S. PATENT DOCUMENTS

| | | | | |
|---|---|---|---|---|
| 7,464,035 | B2 | 12/2008 | Funk et al. | |
| 7,751,578 | B2 | 7/2010 | Arz et al. | |
| 7,778,432 | B2 | 8/2010 | Larsen | |
| 7,860,262 | B2 | 12/2010 | Drtina | |
| 7,929,713 | B2 | 4/2011 | Victorian et al. | |
| 8,150,044 | B2 * | 4/2012 | Goldstein | H04R 25/453 381/317 |
| 8,165,329 | B2 | 4/2012 | Bisgaard | |
| 8,169,938 | B2 | 5/2012 | Duchscher et al. | |
| 8,340,975 | B1 | 12/2012 | Rosenberger | |
| 8,494,198 | B2 | 7/2013 | Aldaz et al. | |
| 8,526,649 | B2 * | 9/2013 | Foo | H04R 25/554 381/312 |
| 8,724,639 | B2 | 5/2014 | Mahmoud | |
| 8,760,284 | B2 * | 6/2014 | Petersen | G08B 1/08 340/4.1 |
| 8,761,421 | B2 * | 6/2014 | Apfel | H04R 25/70 381/313 |
| 8,804,988 | B2 | 8/2014 | Solum et al. | |
| 8,811,639 | B2 | 8/2014 | Solum et al. | |
| 8,868,137 | B2 * | 10/2014 | Hicks, III | G10K 11/1788 368/11 |
| 2002/0067839 | A1 | 6/2002 | Heinrich | |
| 2004/0203387 | A1 | 10/2004 | Grannan | |
| 2005/0071879 | A1 | 3/2005 | Haldavnekar et al. | |
| 2006/0080408 | A1 | 4/2006 | Istvan et al. | |
| 2006/0245609 | A1 | 11/2006 | Arz et al. | |
| 2007/0060118 | A1 | 3/2007 | Guyette | |
| 2007/0298758 | A1 * | 12/2007 | Verma | G08B 27/006 455/404.1 |
| 2008/0111677 | A1 * | 5/2008 | Kolz | G08B 1/08 340/539.11 |
| 2009/0010466 | A1 * | 1/2009 | Haikonen | G08B 1/08 381/315 |
| 2009/0074216 | A1 | 3/2009 | Bradford et al. | |
| 2009/0076816 | A1 | 3/2009 | Bradford et al. | |
| 2009/0115653 | A1 * | 5/2009 | Katrak | B60L 11/1864 341/173 |
| 2010/0067723 | A1 | 3/2010 | Bergmann et al. | |
| 2010/0158292 | A1 | 6/2010 | Pedersen | |
| 2011/0119062 | A1 | 5/2011 | Dohan | |
| 2011/0211584 | A1 | 9/2011 | Mahmoud | |
| 2012/0134507 | A1 | 5/2012 | Dimitriadis et al. | |
| 2012/0171987 | A1 * | 7/2012 | Newman | G08B 17/00 455/404.1 |
| 2012/0213393 | A1 | 8/2012 | Foo et al. | |
| 2012/0275628 | A1 | 11/2012 | Pedersen et al. | |
| 2012/0310394 | A1 | 12/2012 | El-hoiydi | |
| 2014/0233774 | A1 * | 8/2014 | Kim | H04R 25/30 381/315 |
| 2014/0303687 | A1 | 10/2014 | Wall, III et al. | |
| 2014/0341408 | A1 | 11/2014 | Varghese et al. | |
| 2015/0163602 | A1 | 6/2015 | Pedersen et al. | |

OTHER PUBLICATIONS

U.S. Appl. No. 14/864,820, filed Sep. 24, 2015, Method and Apparatus for Using Hearing Assistance Device as Voice Controller.

"U.S. Appl. No. 14/450,041, Non Final Office Action mailed Nov. 23, 2015", 10 pgs.

"U.S. Appl. No. 14/450,041, Response filed Feb. 23, 2016 to Non Final Office Action mailed Nov. 23, 2015", 10 pgs.

"U.S. Appl. No. 14/864,820, Preliminary Amendment filed Apr. 5, 2016", 3 pgs.

"U.S. Appl. No. 14/450,041, Final Office Action mailed May 9, 2016", 13 pgs.

"U.S. Appl. No. 14/450,041, Advisory Action mailed Aug. 10, 2016", 5 pgs.

"U.S. Appl. No. 14/450,041, Response filed Jul. 11, 2016 to Final Office Action mailed May 9, 2016", 11 pgs.

"U.S. Appl. No. 14/864,820, Non Final Office Action mailed Aug. 12, 2016", 8 pgs.

"U.S. Appl. No. 14/450,041, Non Final Office Action mailed Mar. 1, 2017", 14 pgs.

"European Application Serial No. 16190551.8, Extended European Search Report mailed Feb. 15, 2017", 7 pgs.

* cited by examiner

GATEWAY FOR A WIRELESS HEARING ASSISTANCE DEVICE

FIELD OF THE INVENTION

The present subject matter relates generally to hearing assistance devices, and in particular to a gateway for a wireless hearing assistance device.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use transducer and electro-mechanical components which are connected via wires to the hearing aid circuitry.

Hearing assistance devices include the capability to receive audio from a variety of sources. For example, a hearing assistance device may receive audio from a transmitter or streamer attached to a television (TV). While receiving a streaming transmission, the audio from the hearing assistance device microphone is often attenuated to enhance the listener's experience while streaming audio from a wireless device. However, a hearing impaired person that uses or wears a hearing assistance device can become involved with listening to TV programming or other streamed content and might not hear a doorbell, a fire alarm, burglar alarm, weather alert, carbon monoxide alarm, or other serious alert. Additionally, a spouse, family member or friend might want to talk to the hearing assistance device user while they are watching the TV or otherwise not paying attention. What is needed in the art is an improved system for getting an audible message to a user of a hearing assistance device that the user would otherwise not receive.

SUMMARY

Disclosed herein, among other things, are methods and apparatus for providing a gateway for a wireless hearing assistance device.

One aspect of the present subject matter relates to an apparatus, such as a gateway, thr wireless communication with a hearing assistance device. The apparatus includes one or more inputs configured to receive messages and alerts directed to a wearer of a hearing assistance device. A processor is configured to process the messages and alerts to obtain an output adapted to be played via audio to a wearer of the hearing assistance device, and to interrupt a current audio stream being played to the wearer. A wireless transmitter is configured to transmit the output to the hearing assistance device, in various embodiments.

Another aspect of the present subject matter is use in a public multi-cast system. As a wearer of a hearing assistance device comes in the vicinity of a public broadcast service, the streaming audio from the broadcast service can be transmitted via wireless link for reception, in various embodiments.

Another aspect of the present subject matter relates to a method for wirelessly communicating with a hearing assistance device. One or more message and alert inputs are received and the message and alert inputs are processed to obtain an output. The output is wirelessly transmitted to a hearing assistance device, and the output is configured to be played via audio to a wearer of the hearing assistance device and to interrupt a current audio stream being played to the wearer, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
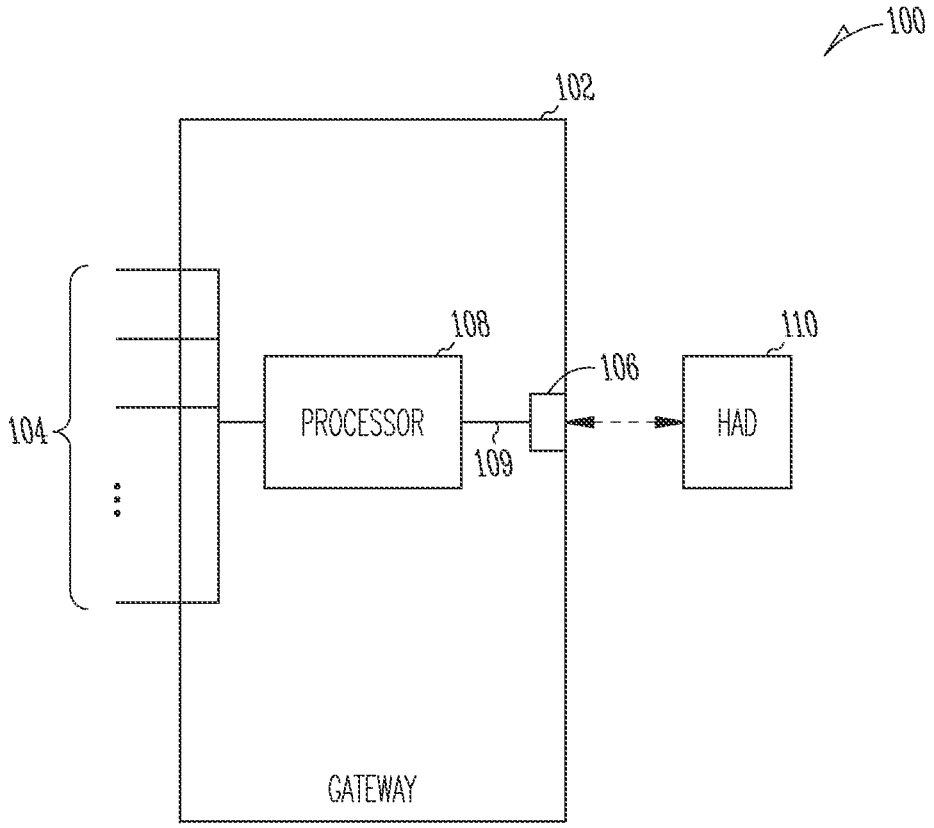
FIG. 1 illustrates a block diagram of a system for wirelessly communicating with a hearing assistance device, according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates generally to hearing assistance devices, and in particular to a gateway for a wireless hearing assistance device. The hearing assistance devices referred to herein include, but are not limited to hearing aids. One aspect of the present subject matter relates to an apparatus for wireless communication with a hearing assistance device. The apparatus includes one or more inputs configured to receive messages and alerts directed to a wearer of a hearing assistance device. A processor is configured to process the messages and alerts to obtain an output adapted to be played via audio to a wearer of the hearing assistance device, and to interrupt a current audio stream being played to the wearer. A wireless transmitter is configured to transmit the output to the hearing assistance device, in various embodiments. In still another embodiment the processor within the hearing assistance device itself is programmed to detect and process audio alarms and other audio alerts and under those circumstances can attenuate the wireless audio stream or other acoustic audio input and alert the wearer of an alarm or alert either by amplifying the alert or by playing an audio alert equivalent to the alarm or alert being acoustically played.

A hearing assistance device with wireless communication capability (or wireless hearing assistance device) allows for new services to be offered to the wireless hearing assistance device user, or wearer. The present subject matter provides for alarms, doorbells, audio messages and text messages to be sent to the hearing assistance device user. To enable these services, an entry to the wireless hearing assistance device is required. Currently a TV streamer offers a level of access into the hearing aid for remote control message forwarding. This subject matter allows for other messages, alarms and alerts to be forwarded to the hearing assistance device user. The messages and alerts are collected by a gateway device, in one embodiment. The gateway device is enabled with a wireless link to the hearing assistance device user, in various embodiments. The hearing assistance device user would receive the messages, alerts and alarms over the wireless link. The hearing assistance device would play the audible message, alert or alarm to the hearing assistance device user. In various embodiments, the gateway device has multiple inputs (wired and/or wireless) for alarms, audio input, doorbells, etc. In one embodiment, messages are sent directly to the hearing assistance device from the gateway device. Alternatively, messages can be sent from a gateway device to an accessory device which forwards the message to the hearing assistance device. In an embodiment, messages are sent from a gateway device to a TV streamer device, where they are mixed with the audio stream by a processor (such as a digital signal processor). Messages are sent via CVSD (continuously variable slope delta modulation), G.722, G.726, AAC or other appropriate audio encoding format that can be decoded by the hearing assistance device, in various embodiments.

In various embodiments, accessories such as TV streamers, wireless audio streaming devices, cell phone interfaces, remote controls, gateways and the like can incorporate a microphone input for the purpose of "listening" for alarms. Alarms such as fire, burglar, CO, etc. and alerts such as a doorbell, weather alert, etc. can be activated when a hearing aid wearer is in the process of listening to digital audio inputs from accessory devices which will further impair the user from hearing these household alarms or alerts. In addition, a user would be less likely to hear an incoming telephone call or doorbell when steaming audio via an accessory device. The wireless accessories or dedicated accessory or audio gateway type devices can be equipped with a microphone, in an embodiment. The microphone is used as an input to monitor the ambient acoustic environment to determine if an alarm is sounding. The unit can be put in a training mode before being deployed for use to "learn" the alarm sounds so that each can be distinguished and then unique alerts can be sent to the hearing aid wearer for each alarm, or a generic alert can be sent just to alert the wearer that an alarm is sounding or a phone is ringing. In various embodiments, acoustic inputs being wirelessly forwarded to hearing instruments from accessory devices. Accessory devices may include cell phones or smart phones having wireless communication capability such as 802.11 (WIFI), Bluetooth or other means of wireless communication with a hearing instrument.

It would also be possible to add this feature to hearing aids as well and bypass the accessories. White streaming, the microphone input can still be monitored for critical alarms going off in the acoustic environment, the microphone input can go active and the wireless input can be muted to help aid the patient in hearing the alarm or be alerted to the alarm. Acoustic alarms can also be translated into voice alerts for the hearing instrument wearer, in an embodiment.

A hearing impaired user of a hearing assistance device can become involved with watching TV or other content on a streamer device, and the microphone audio would be attenuated. Both of these factors make it such that the hearing assistance device user might not notice a doorbell, a fire alarm or other serious alert that the hearing assistance device user should be made aware of. Additionally, a spouse, family member or lieind might want to talk to the hearing assistance device user while they are watching the movie or otherwise not readily paying attention. The present subject matter would also allow for a method to enable a conversation with the hearing assistance device user while the person is in a stream.

The subject matter is intended to be able to get an audible message to the hearing assistance device user. The message is sent to the hearing assistance device user via the wireless link such that the signal is amplified and made audible fir the hearing assistance device wearer, in various embodiments. Alternatively, the message can be relayed through a device like a streamer or other accessory, where the message can be mixed with the audio stream.

In various embodiments, a hearing impaired user might have the volume reduced on their assisted listening device, or the assisted listening device might be in a program to attenuate the hearing assistance device. When the alert comes in, the gateway can pass a data message to increase the volume of the assisted listening device to a normal level, thus overriding attenuated volume settings.

Previously, lights have been used to alert hearing impaired users to alarms or alerts. Otherwise loud volume is required to capture the audio link and to get to the hearing assistance device wearer. The previous solutions do not allow for a multitude of alerts/message sources to be funneled to the hearing assistance device user. The present subject matter allows for multiple inputs from the appropriate sources to all be collected, mixed/processed and sent to the hearing assistance device user through wireless transmission. The messages are then played via audio to the user. Using a streamer presents a new scenario where the hearing impaired might not pay attention to his or her surroundings as they might have previously. This subject matter gets the information to the hearing impaired user, promoting safety in the case of alarms or conveying information to the hearing impaired individual so that they get the message.

One embodiment of the present subject matter includes a gateway as a standalone device to receive the inputs and transmit them wirelessly to the hearing assistance device. Alternatively a computer or smart phone can be configured to accept inputs from various sources, and software on the computer can route the message to a wireless dongle or built in wireless device. The signal can then be sent to the hearing assistance device user directly or via a cellular phone/entertainment device (CPED), TV streamer or other device in wireless communication with the hearing assistance device. A CPED is used to send audio streaming or cell phone audio to the hearing assistance device user. The cell phone can also receive messages via SMS services or via Bluetooth® or other wireless interface. When a CPED is used as a gateway, the cell phone can send the message via Bluetooth® to the CPED, where it can be mixed with other audio signals and sent to the hearing assistance device. When a smart phone or cell phone is used as the gateway device, the signals can be sent directly to the hearing instrument via wireless communication such as 802.11, Bluetooth, Bluetooth low energy or other wireless means.

In various embodiments, the present subject matter provides for training the gateway device by placing the device into a learning mode for each audible alarm within the user's home. For example, the gateway device can be placed in "learn fire alarm" mode and then a fire alarm is set off using the test button on the fire alarm device. This alarm is recorded and statistics of the sound would be analyzed by the gateway device so if it heard the alarm again while in normal operation it can forward a voice command to the hearing assistance device, or it can send a fire alarm message to the hearing assistance device where a locally generated alert can be synthesized on the hearing assistance device itself. The learning mode can be used for all other household alarms of telephone rings, burglar alarms, carbon monoxide (CC)) alarms, smoke detectors, weather alerts, etc. Various embodiments provide for automatic detection of fire alarm sounds (using an ANSI standard, for example). In another embodiment the hearing device itself can be trained to analyze such alerts and understand when to mute the stream and play the alarm or alert or an alarm or alert equivalent notification. In various embodiments, the present subject matter is used in a public multi-cast system. As a wearer of a hearing assistance device comes in the vicinity of a public broadcast service, the streaming audio from the broadcast service can be transmitted via wireless link for reception, in various embodiments.

FIG. 1 illustrates a block diagram of a system for wirelessly communicating with a hearing assistance device, according to one embodiment of the present subject matter. The system 100 includes an apparatus 102, such as a gateway, for wireless communication with a hearing assistance device 110. The apparatus 102 includes one or more inputs 104 configured to receive messages and alerts directed to a wearer of a hearing assistance device. A processor 108 is configured to process the messages and alerts to obtain an output 109 adapted to be played via audio to a wearer of the hearing assistance device, and to interrupt a current audio stream being played to the wearer. A wireless transmitter 106 is configured to transmit the output to the hearing assistance device 110, in various embodiments.

In various embodiments, apparatus 102 includes one or more of the interface embodiments demonstrated in U.S. patent application Ser. No. 13/458,304, filed Apr. 27, 2012, entitled: COMMUNICATION SYSTEM FOR WIRELESS AUDIO DEVICES which claims the benefit under 35 U.S.C. §120 of U.S. patent application Ser. No. 11/447,617, filed Jun. 5, 2006, (now issued as U.S. Pat. No. 8,169,938) which claims the benefit under 35 U.S.C. §119(e) of U.S. Provisional Patent Application Ser. No. 60/687,707, filed Jun. 5, 2005, the entire disclosures of which are all hereby incorporated by reference.

Figure 2:
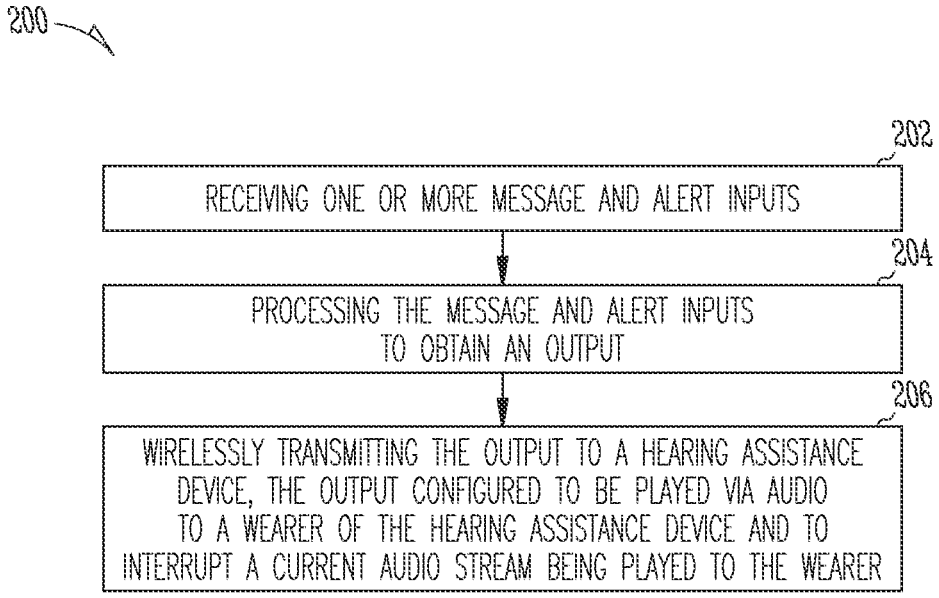
FIG. 2 illustrates a flow diagram of a method for wirelessly communicating with a hearing assistance device, according to one embodiment of the present subject matter.

FIG. 2 illustrates a flow diagram of a method 200 for wirelessly communicating with a hearing assistance device, according to one embodiment of the present subject matter. At 202, one or more message and alert inputs are received and the message and alert inputs are processed to obtain an output, at 204. At 206, the output is wirelessly transmitted to a hearing assistance device, and the output is configured to be played via audio to a wearer of the hearing assistance device and to interrupt a current audio stream being played to the wearer, in various embodiments.

In various embodiments, a method of using a hearing assistance device is provided. The hearing assistance device includes a microphone and a processor and is adapted to be worn by a wearer, in an embodiment. The method includes analyzing an acoustic input to the microphone using the processor to determine whether the acoustic input includes an alarm indication or other alert, and attenuating a wired or wireless audio stream input to the hearing assistance device to alert the wearer about the alarm indication or other alert, in various embodiments.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new figure standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. Processing electronics include a controller, or processor, such as a digital signal processor (DSP), in various embodiments. Other types of processors may be used without departing from the scope of this disclosure. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevet, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter. Further, the present subject matter can be used for persons without hearing impairment that may be using wireless, or wired headphone and earbud devices for listening to audio streams.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of using a hearing assistance device having a microphone and a processor and adapted to be worn by a wearer, the method comprising:

receiving one or more messages and alerts;

processing the messages and alerts using the processor to obtain an output;

analyzing an acoustic input to the microphone using the processor to determine whether the acoustic input includes an alarm indication or other alert; and attenuating a wired or wireless audio stream input to the hearing assistance device configured to compensate for hearing losses of the wearer to alert the wearer about the alarm indication or other alert, wherein the processor is further configured with a learning mode to identify and analyze the alerts to determine when to attenuate the audio stream input, and wherein the output includes information conveyed to the wearer regarding the messages and alerts.

2. The method of claim 1, wherein the alarm indication or other alert includes a fire alarm.

3. The method of claim 1, wherein the alarm indication or other alert includes a telephone ring.

4. The method of claim 1, wherein the alarm indication or other alert includes a smoke detector.

5. The method of claim 1, wherein the alarm indication or other alert includes a carbon monoxide (CO) alarm.

6. The method of claim 1, wherein the alarm indication or other alert includes a burglar alarm.

7. The method of claim 1, wherein the alarm indication or other alert includes a doorbell.

8. The method of claim 1, wherein the alarm indication or other alert includes a severe weather alert.

9. The method of claim 1, wherein the hearing assistance device includes a wireless headset.

10. The method of claim 1, wherein the hearing assistance device includes a hearing aid.

11. The method of claim 10, wherein the hearing aid includes a behind-the-ear (BTE) hearing aid.

12. The method of claim 10, wherein the hearing aid includes an in-the-ear (ITE) hearing aid.

13. The method of claim 10, wherein the hearing aid includes an in-the-canal (ITC) hearing aid.

14. The method of claim 10, wherein the hearing aid includes a completely-in-the-canal (CIC) hearing aid.

15. The method of claim 10, wherein the hearing aid includes a receiver-in-the-canal (RIC) hearing aid.

16. The method of claim 10, wherein the hearing aid includes a receiver-in-the-ear (RITE) hearing aid.

* * * * *